US005152454A

United States Patent [19]

Warta et al.

[11] Patent Number: 5,152,454

[45] Date of Patent: Oct. 6, 1992

[54] ICE CREAM CONE DRIP CATCHER

[76] Inventors: Joseph Warta; Laurie Warta, both of 707 Autumn Leaves Cir., Bishop, Calif. 93514

[21] Appl. No.: 694,954

[22] Filed: May 1, 1991

[51] Int. Cl.[5] ..... B65D 3/06; B65D 3/08

[52] U.S. Cl. ..... 229/1.5 H; 229/DIG. 7; 248/174; 426/130; 426/139

[58] Field of Search ..... 229/1.5 B, 1.5 H, DIG. 7; 426/130, 139; 217/3 FC; 141/331, 337; 248/174

[56] References Cited

U.S. PATENT DOCUMENTS

| | | | |
|---|---|---|---|
| 1,188,048 | 6/1916 | Curtin | 229/1.5 B |
| 1,300,164 | 4/1919 | Guardino | 229/1.5 B |
| 1,435,120 | 11/1922 | Holman | 229/1.5 B |
| 1,852,830 | 4/1932 | Whitcomb | 229/1.5 B |
| 1,854,091 | 4/1932 | Young | 229/1.5 H |
| 2,001,371 | 5/1935 | Thoke | 229/1.5 H |
| 2,145,908 | 2/1939 | Yendrzeyowski | 229/1.5 B |
| 2,939,614 | 6/1960 | Hill | 141/337 |
| 3,135,449 | 6/1964 | Kasper | 229/1.5 B |
| 3,815,646 | 6/1974 | Coakley | 141/337 |
| 4,608,259 | 1/1986 | Cortopassi | 426/115 |
| 4,720,037 | 1/1988 | Alpert | 229/1.5 H |

FOREIGN PATENT DOCUMENTS

| | | | |
|---|---|---|---|
| 174412 | 1/1905 | Australia | 229/1.5 B |
| 572945 | 11/1958 | Belgium | 229/1.5 B |

*Primary Examiner*—Gary E. Elkins
*Attorney, Agent, or Firm*—Mark D. Miller

[57] ABSTRACT

A ice cream cone drip catching wrapper made from a single sheet which is folded to create an upper conical section, and a lower cylindrical section to fit closely around an ice cream cone. The wrapper is held in place either by tabs and slots or by adhesive material, and provides a way to control melting dripping ice cream coming off of an ice cream cone. The wrapper enables an ice cream cone to be easily inserted therein for delivery in a suitable manner to the user.

20 Claims, 3 Drawing Sheets

ICE CREAM CONE DRIP CATCHER

BACKGROUND OF THE INVENTION

The present invention relates to ice cream cone holders, and in particular to a wrapper for controlling the dripping of a standard ice cream cone as well as a sugar cone.

For many years, over the counter ice cream parlors, fast food restaurants, and in particular, mothers of small children have faced the problems presented by dripping ice cream cones.

Ice cream cones, such as those sold by ice cream parlors and fast food restaurants are notorious for melting very quickly in the hands of the consumer especially in the heat of the summer. The problems posed by melting, dripping ice cream include messy napkins leading to messy, sticky hands, then clothes, furniture, floors, automobile interiors, etc.

Presently, the best solution available to the problem of ice cream dripping down the side of the cone is to tightly wrap a napkin or piece of paper around the cone. Unfortunately, present methods do not provide adequate protection for hands, clothing, floor areas, furniture or the inside of a (moving) automobile where an ice cream cone is present in the unsteady hand of a small child.

The ice cream parlor and fast food restaurant industries typically sell a large number of ice cream cones and require speedy delivery of foods, in particular-ice cream cones, and cannot afford to take lengthy and complicated measures to protect against melting, dripping ice cream. Moreover, the less the comestible portion of the ice cream and cone come into direct contact with human hands, the less the likelihood of spreading germs, viruses and/or bacteria. Any such measures should not interfere with the user's ability to easily access and consume the ice cream and the cone.

SUMMARY OF THE INVENTION

Accordingly, it is the primary object of the present invention to provide an easily installed disposable wrapper which is placed around an ice cream cone to protect the user from excessive dripping of ice cream onto hands, clothing, floors, or the inside of a (moving) automobile, etc.

It is a further object of this invention to provide a disposable ice cream cone drip containment wrapper which may be easily and rapidly installed at the ice cream parlor or fast food restaurant.

It is a further object of this invention to provide a disposable ice cream cone drip containment wrapper which eliminates the over-handling of the comestible, an ice cream cone.

It is a further object of the present invention to provide a disposable ice cream cone drip containment wrapper into which a comestible product, in particular an ice cream cone, is inserted and delivered to a customer in a suitable manner.

It is a further object of the present invention to provide an ice cream cone containment wrapper which is relatively inexpensive (a significant consideration to the buyer and seller), and which also is typically disposed of after a single usage.

It is a further object of the present invention to provide an ice cream cone containment wrapper using flexible, waterproof, or wax-coated material of minimal cost, as the wrapper is thrown away after a single usage.

It is a further object of the present invention to provide an alternative ice cream cone drip containment wrapper having tabs and slots located thereon which allow the wrapper to be easily set in place around an ice cream cone.

It is a further object of the present invention to provide an ice cream cone drip containment wrapper having adhesive surfaces thereon which allow the wrapper to be easily set in place around an ice cream cone.

It is a further object of the present invention to provide an ice cream cone drip containment wrapper that does not interfere with access to the ice cream or the cone contained therein, and which may be slided down the length of the ice cream cone to provide continued protection from otherwise inevitable messy handling as the ice cream cone is consumed.

It is a further object of the present invention to provide an ice cream cone drip containment wrapper that may be used on a variety of ice cream cones including without limitation sugar cones, standard wafer cones, waffle cones, and the like.

DESCRIPTION OF THE PREFERRED EMBODIMENTS

In accordance With the teachings herein, the present invention provides a simple and versatile disposable ice cream cone drip containment wrapper that may be cut out of a single sheet of material. The wrapper is specially designed so that it may be folded upon itself to form two separate sections, one having a mostly conical shape, and the other having a mostly cylindrical shape. The conically-shaped section is at the top and is designed to surround the wider upper opening of a standard (wafer) ice cream cone. Immediately below the conical section is a cylindrical region having a wider diameter at its top than at its bottom. The lower cylindrical section is designed to fit around the narrow body of a standard (wafer) ice cream cone.

A modified form of the invention is provided for use on sugar cones or the like wherein the cylindrical region has a tapered and slightly conical shape from top to bottom in conformity with the contours of the ice cream cone.

In practice, the conical section should be folded into place first, followed thereafter by the cylindrical (or tapered cylindrical) section. In this way, the cylindrical section will fit snugly against the conical section to provide a form of seal between the sections to keep melting, dripping ice cream on the inside of the wrapper, and away from hands, clothing, floor areas, furniture, the inside of a (moving) car, or the like. As the ice cream and cone are consumed, the wrapper may be slided down the length of the cone, and crumbled against it until the last of the cone is consumed.

The preferred embodiment of the invention includes a tab-and-slot means on the conical section, and a separate tab-and-slot means on the cylindrical section. Each of these tab-and-slot means allows for quick, easy construction of the wrapper prior to insertion of the filled ice cream cone.

In an alternative embodiment, the tab-and-slot means may be replaced by adhesive surfaces (described in the drawings with phantom lines). In use, this alternative embodiment would require the conical section to be wrapped so that it adheres to itself first, followed thereafter by the wrapping of the cylindrical section against its separate adhesive material.

In greater detail, the flattened pattern for the wrapper is in a modified question mark shape (see FIG. 1), and includes a mostly circular portion (18) which when folded forms the conical section; and a separate tail-shaped section (17) which when folded forms the cylindrical section which wraps around the base of the ice cream cone. Each of the sections wraps in the same direction, (i.e., both clockwise, or both counterclockwise) for ease of installation.

The outside of the conical section, as well as the outside of the cylindrical section may be provided with decorative and/or trademark printing.

DETAILED DESCRIPTION OF THE DRAWINGS

Figure 1:
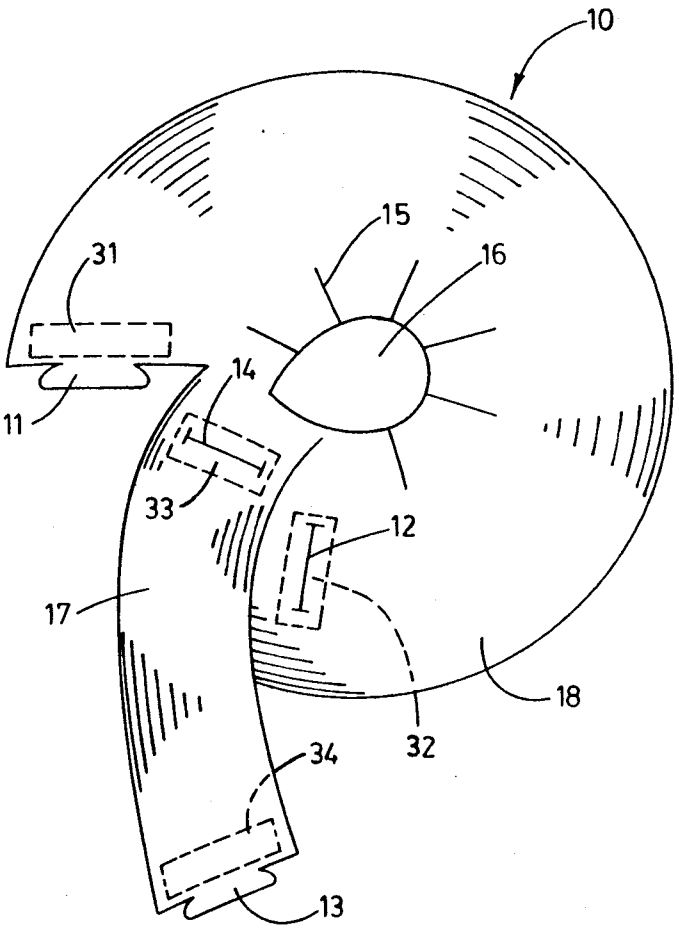
FIG. 1 is pattern for a flat paper blank of one embodiment (wafer cone) of the invention prior to folding and formation thereof into the wrapper of the present invention.

In the drawings wherein like reference characters designate like or corresponding parts throughout the several views, and referring particularly to FIG. 1 it is seen that the invention comprises a pattern in the form of a blank 10 which may be cut out of paper, cardboard, plastic, wax coated paper or other suitable flexible material. The blank 10 is comprised of an outer donut-shaped section 18 having a central opening 16 surrounded by slits 15. A tail section 17 is provided which is attached to the donut-shaped section 18. All of the solid lines shown in FIG. are designed to be cut out to form the wrapper which fits around an ice cream cone 19 (wafer cone) as shown in FIG. 5.

Figure 2:
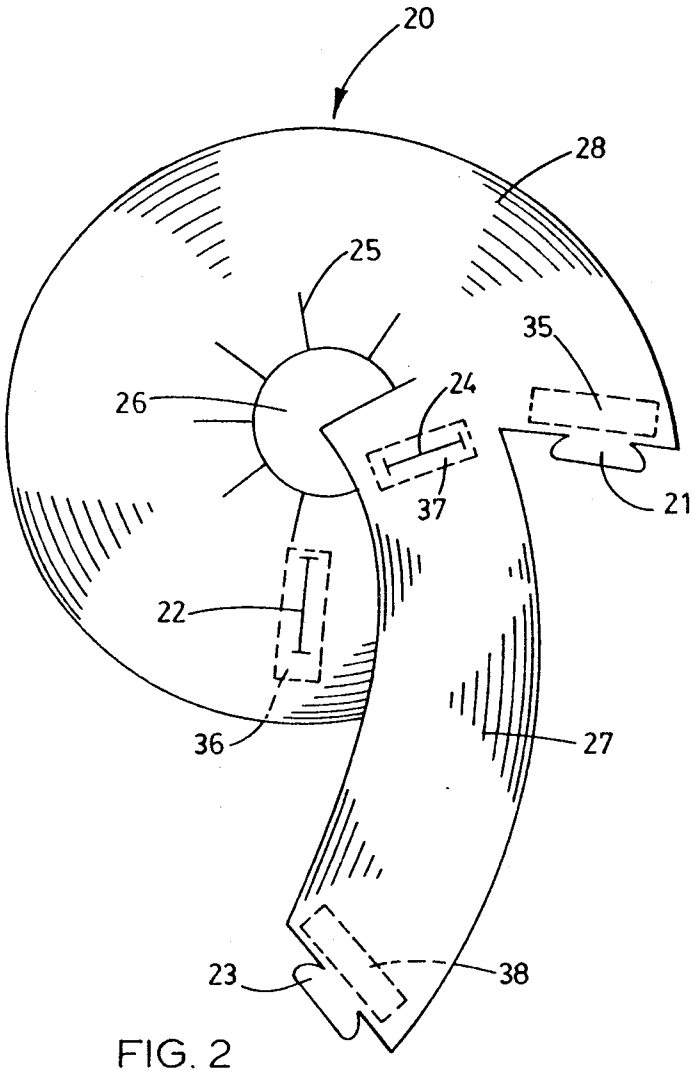
FIG. 2 is pattern for a flat paper blank of another embodiment (sugar cone) of the invention prior to folding and formation thereof into the wrapper of the present invention.
Figure 6:
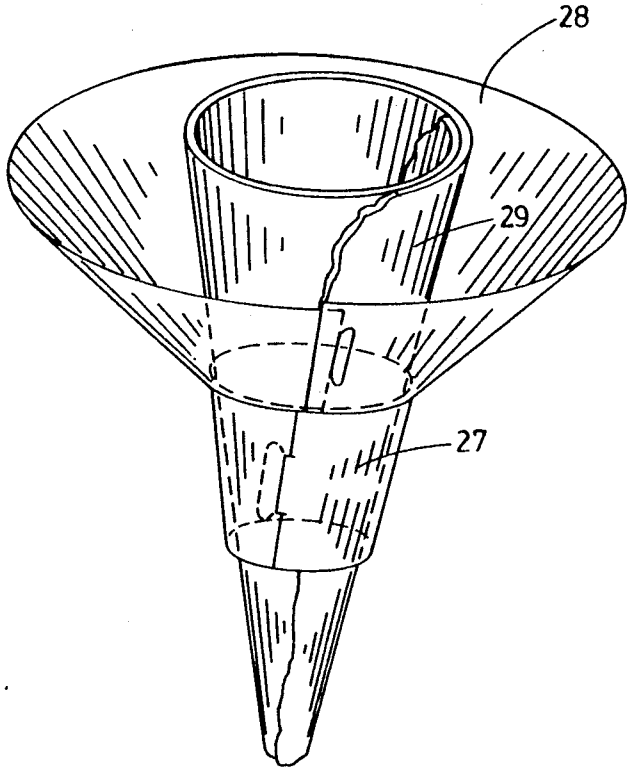
FIG. 6 is a perspective view of another embodiment (sugar cone) of the invention in place around an ice cream cone after both the conical and cylindrical sections have been folded.

An alternative embodiment 20 is disclosed in FIG. 2 wherein the donut-shaped section 28 and the tail section 27 have modified shapes in order to fit around a differently shaped ice cream cone 29 (sugar cone) seen in FIG. 6.

Figure 4:
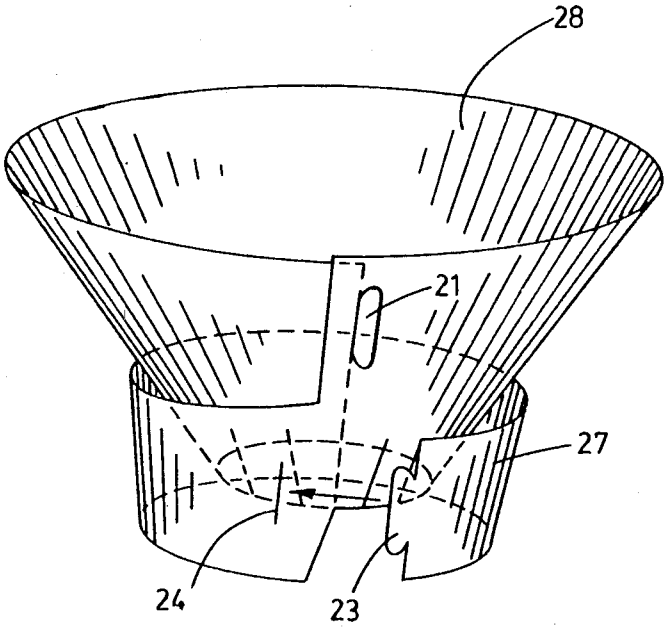
FIG. 4 is a view of another embodiment (sugar cone) of the invention after the upper conical section has been folded together showing the lower tapered cylindrical section nearly folded in place.
Figure 3:
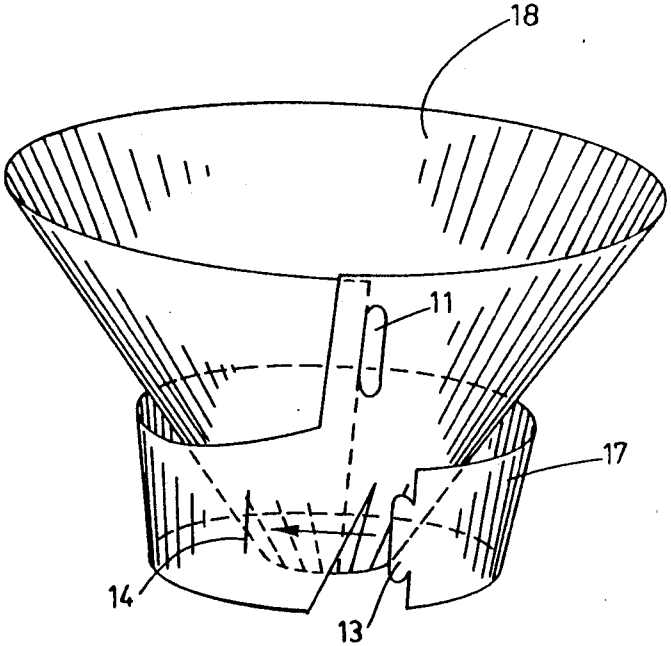
FIG. 3 is a view of one embodiment (wafer cone) of the invention after the upper conical section has been folded together showing the lower cylindrical section nearly folded in place.

A tab 11 and corresponding slot 12 as shown in FIG. 1 is provided in the donut-shaped section 18 in order to hold that section (18) in place as a cone as shown in FIG. 3. Tab 21 and slot 22 in the alternative embodiment of FIG. 2 perform the same function as shown in FIG. 4.

Figure 5:
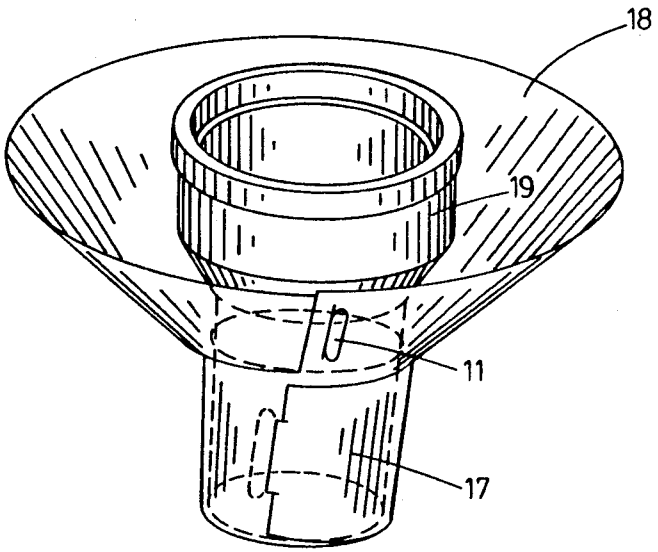
FIG. 5 is a perspective view of one embodiment (wafer cone) of the invention in place around an ice cream cone after both the conical and cylindrical sections have been folded.

A separate tab 13 and slot 14 are provided in the tail of the blank in FIG. 1 to form the cylindrically shaped lower section 17 shown in FIG. 3 and FIG. 5. Similarly, tab 23 and slot 24 in FIG. 2 perform the same function to hold tapered cylindrical section 27 in place as shown in FIG. 4 and FIG. 6.

As an alternative to the tabs 11 and 13 of FIG. 1 (21 and 23, respectively of FIG. 2) and slots 12 and 14 of FIG. 1 (22 and 24, respectively of FIG. 2), adhesive surfaces 31 and 32 in FIG. 1 (35 and 36, respectively in FIG. 2) may be provided in order to hold the conical section 18 of FIG. 1 (28 of FIG. 2) together. Adhesive surface 32 of FIG. 1 (36 of FIG. 2) is on the back side of the blank 18 of FIG. 1 (28 of FIG. 2). Similarly, adhesive surfaces 33 and 34 of FIG. 1 (37 and 38 of FIG. 2) may be provided on the tail 17 of FIG. 1 (27 of FIG. 2) instead of tab 13 of FIG. 1 (23 of FIG. 2) and slot 14 of FIG. 1 (24 of FIG. 2).

In the preferred embodiment, the present invention may be made of paper, cardboard, plastic; wax coated paper, or other suitable flexible material. The exact size of the invention may be adjusted for different sized ice cream cones. This includes adjusting the positioning and/or length of the tail section 17 (or 27), as well as the outer arc of the donut-shaped section 18 (or 28).

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

We claim:

1. An ice cream cone drip containment wrapper for a comestible product comprising a single sheet of flexible disposable material having its inside and outside edges cut substantially on the arcs of concentric circles defining a strip having a leading end and a trailing end wherein a tail is attached to said trailing end, said tail defined by a second series of arcs of concentric circles defining a crescent having a separate leading end and trailing end.

2. The wrapper described in claim 1 wherein said strip defines an arc of between 250 and 290 degrees, the inside edge of said strip being slitted to form tongues that come into contact with said cone.

3. The wrapper described in claim 2 wherein the trailing end of said tail is attached to the trailing end of said strip at one corner near the slitted inside edge.

4. The wrapper described in claim 3 wherein a first tab is provided at the leading end of the strip, and a corresponding first slot is provided near the trailing end of said strip, so that said first tab may be placed into said first slot in order to firmly hold together the cone formed by said strip into which an ice cream cone may be placed.

5. The wrapper described in claim 4 wherein a second tab is provided at the leading end of the tail, and a corresponding second slot is provided near the trailing end of said tail, so that said second tab may be placed into said second slot in order to firmly hold together the cylinder formed by said tail into which the body of an ice cream cone may be placed.

6. The wrapper described in claim 3 wherein a first adhesive strip is provided at the leading end of the strip, so that said first adhesive strip may adhere to the trailing end of said strip in order to firmly hold together the cone formed by said strip into which an ice cream cone may be placed.

7. The wrapper described in claim 6 wherein a second adhesive strip is provided at the leading end of the tail, so that said second adhesive strip may adhere to the trailing end of the tail in order to firmly hold together the cylinder formed by said tail into which the body of an ice cream cone may be placed.

8. The wrapper described in claim 3 wherein a pair of adhesive strips are provided on said strip, the first such strip being on the upper surface of said sheet at the leading end of the strip, and said second strip being on the opposite surface of said sheet at the trailing end of said strip, so that said adhesive surfaces may be placed against one another in order to firmly hold together the cone formed by said strip into which an ice cream cone may be placed.

9. The wrapper described in claim 8 wherein a second pair of adhesive surfaces are provided on said tail, the first such surface being on the upper surface of said tail near the leading end, and the other such surface on the opposite surface of said tail at the trailing end, so that said adhesive surfaces may be placed over one another in order to firmly hold together the cylinder formed by said tail into which the body of an ice cream cone may be placed.

10. An ice cream cone drip containment wrapper as described in claim 3 in combination with a comestible product, said comestible product comprising an ice cream cone.

11. An ice cream cone drip containment wrapper for comestible product as described in claim 3 wherein the upper surface of said strip displays decorative and trademark printing thereon, and also reinforcing the strength of said strip.

12. An ice cream cone drip containment wrapper for a comestible product comprising:

a. a blank cut into a circular arc of between 250 and 270 degrees having an outside edge and an inside edge, a leading end and a trailing end, said inside edge surrounding a central opening, b. a series of slits cut part way into the inside edge of said circular arc and away from said central opening, c. a crescent shaped tail extending outwardly away from said arc, attached to said circular arc only at one corner.

13. The wrapper described in claim 12 wherein a first tab is provided at the leading end of the circular arc, and a corresponding first slot is provided near the trailing end of said arc, so that said first tab may be placed into said first slot in order to firmly hold together the cone formed by said arc into which an ice cream cone may be placed.

14. The wrapper described in claim 13 wherein a second tab is provided at the leading end of the tail, and a corresponding second slot is provided near the trailing end of said tail, so that said second tab may be placed into said second slot in order to firmly hold together the cylinder formed by said tail into which the body of an ice cream cone may be placed.

15. The wrapper described in claim 12 wherein a first adhesive strip is provided at the leading end of the circular arc, so that said first adhesive strip may adhere to the trailing end of said arc in order to firmly hold together the cone formed by said arc into which an ice cream cone may be placed.

16. The wrapper described in claim 12 wherein a second adhesive strip is provided at the leading end of the arc, so that said second adhesive strip may adhere to the trailing end of the tail in order to firmly hold together the cylinder formed by said tail into which the body of an ice cream cone may be placed.

17. The wrapper described in claim 12 wherein a pair of adhesive strips are provided on said circular arc, the first such strip being on the upper surface of said sheet at the leading end of the arc, and said second strip being on the opposite surface of said sheet at the opposite end of said arc, so that said adhesive surfaces may be placed against one another in order to firmly hold together the cone formed by said strip into which an ice cream cone may be placed.

18. The wrapper described in claim 12 wherein a second pair of adhesive surfaces are provided on said tail, the first such surface being on the upper surface of said tail near the leading end, and the other such surface on the opposite surface of said tail at the trailing end, so that said adhesive surfaces may be placed over one another in order to firmly hold together the cylinder formed by said tail into which the body of an ice cream cone may be placed.

19. An ice cream cone drip containment wrapper as described in claim 12 in combination with a comestible product, said comestible product comprising an ice cream cone.

20. An ice cream cone drip containment wrapper for comestible product as described in claim 12 wherein the upper surface of said arc displays decorative and trademark printing thereon, and also reinforcing the strength of said arc.

* * * * *